US008044568B2

(12) United States Patent
Inoue

(10) Patent No.: US 8,044,568 B2
(45) Date of Patent: Oct. 25, 2011

(54) LIGHT EMITTER SUBSTRATE WITH DIFFERENT GAPS BETWEEN METAL BACKS AND IMAGE DISPLAYING APPARATUS USING THE SAME

(75) Inventor: Yukihiro Inoue, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 12/549,442

(22) Filed: Aug. 28, 2009

(65) Prior Publication Data

US 2010/0052510 A1 Mar. 4, 2010

(30) Foreign Application Priority Data

Sep. 4, 2008 (JP) ..... 2008-226616

(51) Int. Cl.
*H01J 31/12* (2006.01)
*H01J 1/62* (2006.01)

(52) U.S. Cl. ..... 313/496; 313/495; 313/292; 445/24

(58) Field of Classification Search ..... 313/495, 313/496

See application file for complete search history.

(56) References Cited

U.S. PATENT DOCUMENTS

| | | | | |
|---|---|---|---|---|
| 7,400,082 | B2 * | 7/2008 | Suzuki et al. | 313/473 |
| 2008/0174230 | A1 * | 7/2008 | Ibuki et al. | 313/496 |
| 2009/0184658 | A1 | 7/2009 | Inoue et al. | 315/291 |
| 2009/0302735 | A1 | 12/2009 | Yamazaki et al. | 313/307 |
| 2009/0309480 | A1 | 12/2009 | Inoue | 313/473 |
| 2009/0310360 | A1 | 12/2009 | Inoue | 362/249.01 |
| 2010/0033076 | A1 * | 2/2010 | Yamazaki | 313/496 |

FOREIGN PATENT DOCUMENTS

| | | | |
|---|---|---|---|
| JP | 2006-173094 | A | 6/2006 |
| JP | 2007134084 | A * | 5/2007 |

OTHER PUBLICATIONS

Machine English transaltion of JP 2007134084 to Iguchi et al.*

* cited by examiner

*Primary Examiner* — Sikha Roy
(74) *Attorney, Agent, or Firm* — Fitzpatrick, Cella, Harper & Scinto

(57) ABSTRACT

To provide a light emitter substrate which is characterized in that discharge current reduction performance is excellent, plural phosphors are arranged in an X direction and a Y direction on a substrate, metal backs are arranged on the phosphors, ribs extending in the Y direction are arranged between the phosphors adjacent in the X direction, first resistors to electrically connect the metal backs adjacent in the Y direction are formed on the ribs respectively, and second resistors to electrically connect the metal backs adjacent in the X direction are formed under the ribs respectively.

2 Claims, 6 Drawing Sheets

LIGHT EMITTER SUBSTRATE WITH DIFFERENT GAPS BETWEEN METAL BACKS AND IMAGE DISPLAYING APPARATUS USING THE SAME

BACKGROUND OF THE INVENTION

1. Field of the Invention

The present invention relates to a light emitter substrate which is applied to a face plate of an electron beam displaying apparatus, and an image displaying apparatus which is constituted by using the light emitter substrate.

2. Description of the Related Art

In recent years, a flat panel image displaying apparatus in which an electron source substrate on which a number of electron-emitting devices are arranged and a light emitter substrate on which plural light emitter layers emitting light in response to irradiation of electrons emitted from the electron-emitting devices are arranged are opposed to each other has been developed as a next-generation image displaying apparatus. Although there are different kinds of electron-emitting devices, these devices basically use field emission. Therefore, such a displaying apparatus which uses these electron-emitting devices is generally called an FED (field emission display). In the various FEDs, the displaying apparatus which uses surface conduction electron-emitting devices is specifically called an SED (a surface-conduction electron-emitter display). However, in the present application, the term FED is used as the generic term which includes the SED.

The FED has the electron source substrate (i.e., a rear plate) and the light emitter substrate (i.e., a face plate) which are oppositely arranged at a narrow gap of approximately 1 mm to 2 mm. These substrates constitute a vacuum envelop by mutually bonding the respective peripheral portions thereof through a rectangle-frame side wall. A degree of vacuum of the inside of the vacuum envelope is maintained at high vacuum of approximately $10^{-4}$ Pa or less.

On the inner surface of the electron source substrate, a large number of electron-emitting devices for emitting electrons are provided, a large number of scanning lines and signal lines are formed in matrix, and the scanning line and the signal line are connected to each of the electron-emitting devices. On the inner surface of the light emitter substrate, R (red), G (green) and B (blue) phosphors are formed as a light emitter layer, and an anode voltage is applied to the formed phosphors. If electron beams emitted from the electron-emitting devices and accelerated by the anode voltage collide with the phosphors, the phosphors emit light, whereby an image is displayed. Further, a rib is provided between the phosphors so as to prevent that a part of incident electrons is reflected on the arbitrary phosphor and the reflected electrons enter into the phosphor adjacent to the arbitrary phosphor.

In order to obtain a practical displaying characteristic in the FED constituted as described above, the phosphors which are the same as those in an ordinary cathode ray tube are used, and further an aluminum thin film called a metal back is formed on the phosphors. In this case, it is desirable that the anode voltage to be applied to the metal back is set to several kilovolts at the lowest, preferably to 10 kV or higher.

However, the gap between the light emitter substrate and the electron source substrate cannot be so enlarged from the aspect of resolution, a characteristic of a spacer, and the like. More specifically, it is necessary to set the relevant gap to approximately 1 mm to 2 mm. Therefore, in the FED, it is impossible to avoid generating a high electric field at the above-described small gap between the light emitter substrate and the electron source substrate, whereby a problem of a discharge between these substrates generates.

If any countermeasure is not introduced to suppress damage by the discharge, the electron-emitting device, the phosphor, a driver IC, a driving circuit and the like are damaged and/or deteriorated due to the discharge. Here, it is assumed that such damages and deteriorations are collectively called discharge damage hereinafter. Under the circumstance that the discharge damage occurs, it is necessary to absolutely prevent the discharge from generating over the long term so as to put the FED to practical use. However, it is extremely difficult to achieve such a countermeasure.

Consequently, a countermeasure for reducing, even if the discharge generates, a discharge current is important so as to be able to suppress the discharge to the level that the discharge damage does not occur or can be ignored. To achieve this, a technique of dividing the metal back (i.e., an anode electrode) has been known. Here, it should be noted that such metal back division roughly includes primary division that the metal back is divided in one direction into plural strip-shaped metal backs and secondary division that the metal back is divided in two directions into plural island-shaped metal backs. In the secondary division, it is possible to reduce the discharge current as compared with the primary division.

In the case where the metal back is divided, it is necessary to secure a route for a beam current so as to suppress luminance deterioration within an acceptable level, and it is also necessary to prevent the discharge which is generated due to a potential difference at the gap formed by the division. In this connection, Japanese Patent Application Laid-Open No. 2006-173094 (corresponding to United States Patent Application Publication US2006/0103294) discloses the constitution in which a resistor is provided between divided metal backs.

However, even in the technique disclosed in Japanese Patent Application Laid-Open No. 2006-173094, further improvement is requested in regard to increase of the luminance, increase of the image quality, suppression of generation of the discharge, and suppression of the scale of the generated discharge.

SUMMARY OF THE INVENTION

The present invention has been completed to solve such a problem as suggested in the related art, and aims to provide a light emitter substrate which is characterized in that discharge current reduction performance is excellent, and an image displaying apparatus in which the relevant light emitter substrate is used.

According to a first aspect of the present invention, there is provided a light emitter substrate comprising:

a substrate;

plural light emitter layers arranged in a first direction and in a second direction perpendicular to the first direction respectively at gaps, on the substrate;

a rib arranged between the light emitter layers adjacent in the second direction and extending the first direction;

plural metal backs each covering at least one of the light emitter layers and arranged in the first direction and in the second direction respectively at gaps;

a first resistor, positioned on the rib, adapted to electrically connect the metal backs adjacent in the first direction; and a second resistor, positioned between the ribs and the substrate, adapted to electrically connect the metal backs adjacent in the second direction, wherein volume resistance of the first resistor and volume resistance of the second resistor are lower than volume resistance of the rib.

According to a second aspect of the present invention, there is provided an image displaying apparatus wherein an electron source substrate which is equipped with plural electron-emitting devices and the light emitter substrate which is described as the first aspect of the present invention are mutually arranged oppositely.

According to the present invention, it is possible to provide the image displaying apparatus which is characterized in that the discharge current reduction performance is excellent.

Further features of the present invention will become apparent from the following description of the exemplary embodiment with reference to the attached drawings.

DESCRIPTION OF THE EMBODIMENT

Hereinafter, the exemplary embodiment of the present invention will be described with reference to the attached drawings.

Figure 1A:
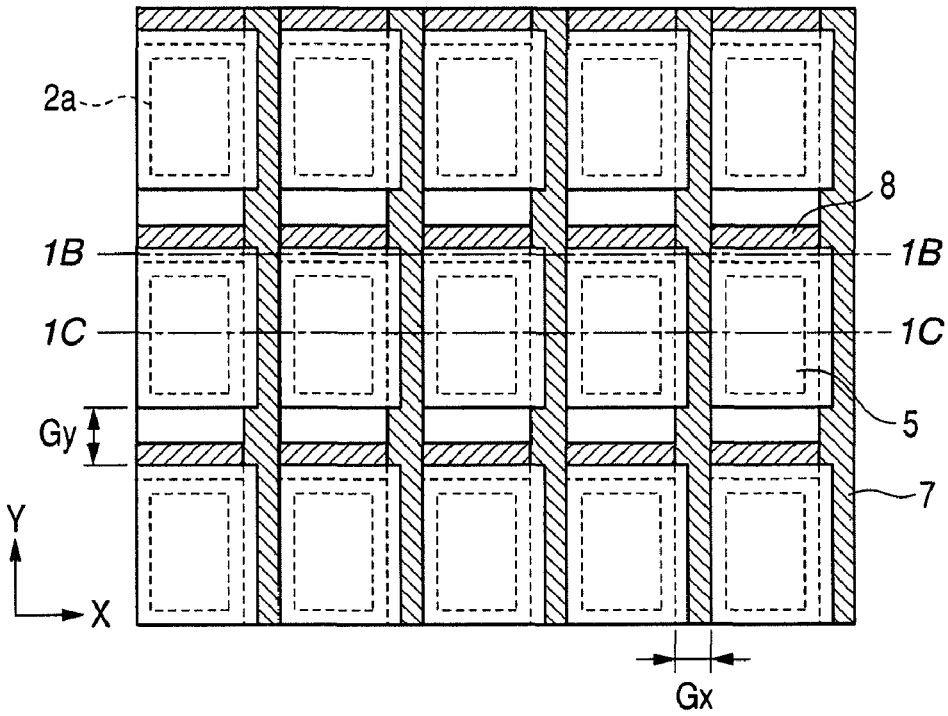
FIGS. 1A, 1B and 1C are diagrams schematically illustrating a constitution of a light emitter substrate according to the present invention.
Figure 1B:
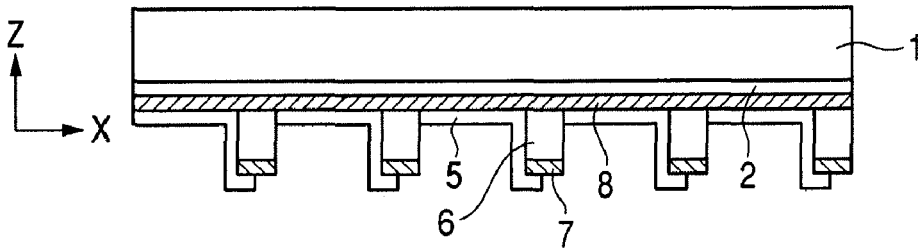
Figure 1C:
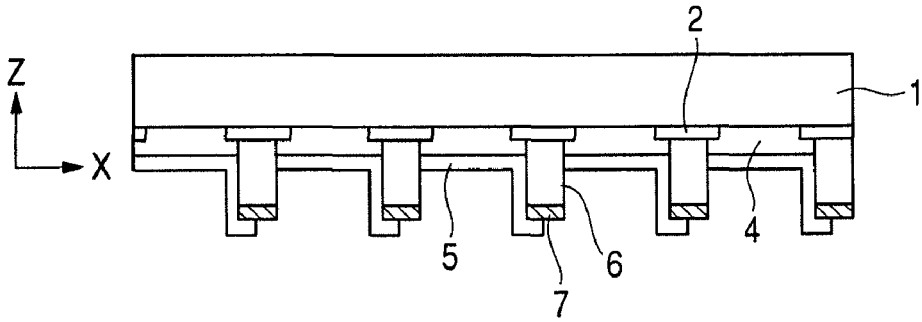

Initially, a general constitution of an FED to which the present invention is applied will be described with reference to FIGS. 1A, 1B and 1C. More specifically, FIG. 1A is the diagram illustrating the inside of a light emitter substrate according to the present invention, FIG. 1B is the cross section diagram taken along the line 1B-1B in FIG. 1A, and FIG. 1C is the cross section diagram taken along the line 1C-1C in FIG. 1A. In the embodiment of the present invention, it is assumed that a first direction is a Y direction and a second direction perpendicular to the first direction is an X direction.

Plural phosphors 4 which act as a light emitter layer of the present invention are arranged in the X direction and the Y direction at respective intervals on the inner surface of a substrate 1. Here, it should be noted that, as a method of applying the phosphors 4 onto the substrate 1, it is possible to adopt a sedimentation method, a screen printing method, a dispenser method, or the like irrespective of whether the phosphors 4 are monochrome phosphors or color phosphors. Further, typically, black stripes or black matrices made by black members are formed on the substrate 1, and the phosphors 4 are arranged on the respective aperture portions of the black stripes or the black matrices. More specifically, FIGS. 1A to 1C illustrate a black matrix 2 and an aperture portion 2*a* by way of example.

Further, plural metal backs 5 which function as anode electrodes are formed respectively in the X direction and the Y direction on the phosphors 4 so that each of the metal backs 5 covers at least one phosphor 4. More specifically, in the present embodiment, each metal back 5 covers the one phosphor 4. Here, it should be noted that, as a method of forming the metal backs 5 divided respectively in the X direction and Y direction, it is possible to adopt a method of initially forming the metal back 5 on the overall substrate 1 on which the phosphor 4 has been formed, and then patterning the formed metal back 5 by photo etching (this method is called a photolithography method). Also, it is possible to timely select a method of performing vacuum vapor deposition by using a metal mask having desired apertures as a shielding member (this method is usually called a mask vapor deposition method).

The numerous phosphors 4 which emit red (R) light, green (G) light and blue (B) light are disposed on the substrate 1. Here, an FED which has a typical landscape screen is assumed. In this case, if a long axis direction of the screen is set as the X direction and a short axis direction of the screen is set as the Y direction, the phosphors are repetitively arranged in the X direction and the Y direction at predetermined pitches respectively. Here, it should be noted that the predetermined pitch is allowed to be varied within a range of manufacturing error or a range of design convenience.

Further, a striped rib 6 which extends in the Y direction is provided between the adjacent phosphors (R, G and B phosphors) 4 which are arranged in the X direction. In any case, the plural ribs 6 function to prevent that a part of the electrons entering the phosphors 4 is reflected and the reflected electrons enter the adjacent phosphor 4 which is adjacent in the X direction. A first resistor 7 which extends along the rib 6 is provided on the rib (i.e., a rib top), and the first resistor 7 is connected to an electrode which supplies anode potential outside an image displaying region. Further, a second resistor 8 which extends in the direction (X direction) crossing the first resistor 7 is provided under the rib (i.e., a rib bottom). Here, the second resistor 8 is formed so as to electrically connect the metal backs 5 which are adjacent in the Y direction. It should be noted that, as a method of forming the ribs 6, the first resistors 7 and the second resistors 8, it is possible to adopt a photolithography method, a screen printing method, a dispenser method, or the like.

Here, it is assumed that a gap between the metal backs 5 in the X direction is Gx and a gap between the metal backs 5 in the Y direction is Gy. Then, since the R, G and B phosphors 4 are arranged in the X direction, the relation $Gx < Gy$ is satisfied generally. Incidentally, in FIGS. 1A to 1C, the divisional pitch of the metal backs 5 in the Y direction can be properly selected according to a discharge current specification, process convenience, and the like. As just described, in the case where the relation $Gx < Gy$ is satisfied, an influence of adjacent cross talk (i.e., halation) due to the reflected electrons remarkably appears in the X direction. For this reason, as described above, the column-striped rib which extends in the column direction (Y direction) is formed between the phosphors which are adjacent to each other in the X direction. It is possible by means of the formed ribs to prevent that the reflected electrons enter the phosphor which is adjacent in the X direction. Incidentally, if the rib is manufactured by an insulating member such as glass or the like, resistance between the divided metal backs in the X direction is high, whereby a voltage which is generated at the time of discharge increases. Moreover, since the gap between the metal backs 5 in the X direction is narrow, there is a problem that a withstand discharge break occurs in the gap Gx. That is, in a case where the generated voltage exceeds the withstand discharge of the rib, the withstand discharge break occurs. Then, if a chain of the withstand discharge break occurs in the X direction, the metal backs are connected mutually at low impedance, whereby a large current flows because current limitation based on the two-dimensional division does not function. Consequently, in the present invention, since the second resistor 8 is provided under the rib (i.e., the rib bottom) to decrease the resistance in the X direction, it is possible to suppress the voltage generated in the gap Gx at the time of discharge.

In the present invention, it is desirable for the purpose of manufacture to make the shape of the first resistor 7 simple strip as exemplarily illustrated in FIGS. 1A to 1C. However, it should be noted that the first resistor 7 aims to adjust resistance Ry of the gap Gy. That is, if the first resistor 7 is formed so as to electrically connect the adjacent metal backs 5 in the Y direction, it is possible to arbitrarily select the shape thereof. Therefore, it is of course possible to make the shape of the first resistor 7 complicated, and it is also possible to make the shape of the first resistor 7 discontinuous by intermittently forming it.

Figure 2A:
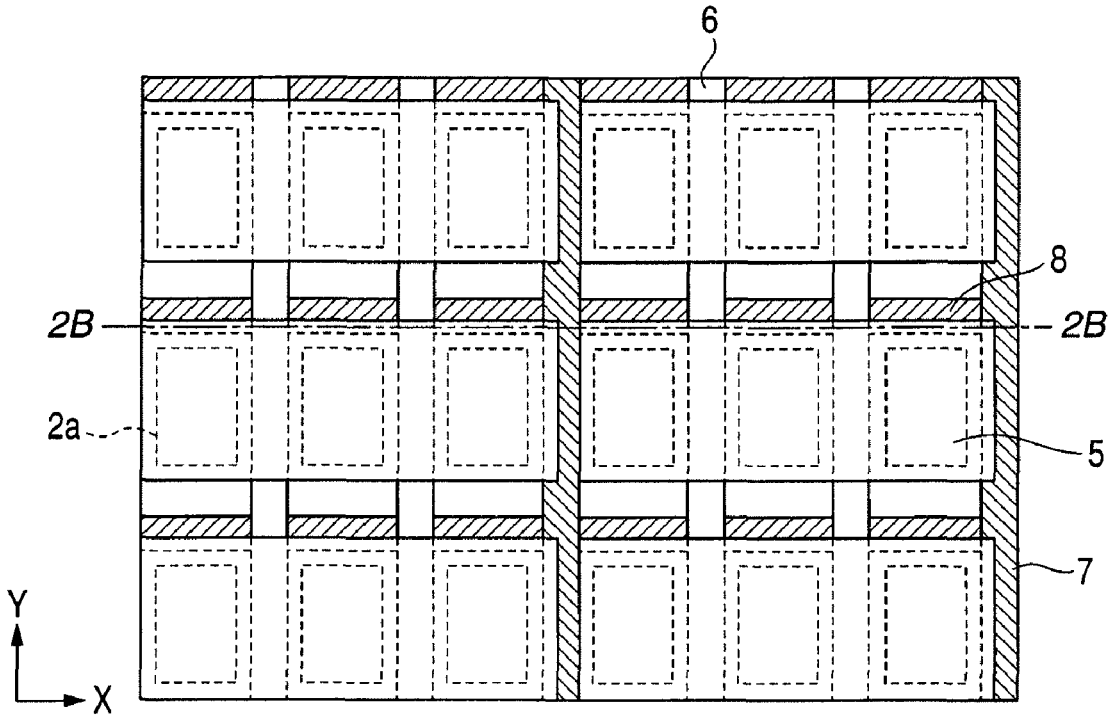
FIGS. 2A and 2B are diagrams schematically illustrating another constitution of the light emitter substrate according to the present invention.
Figure 2B:
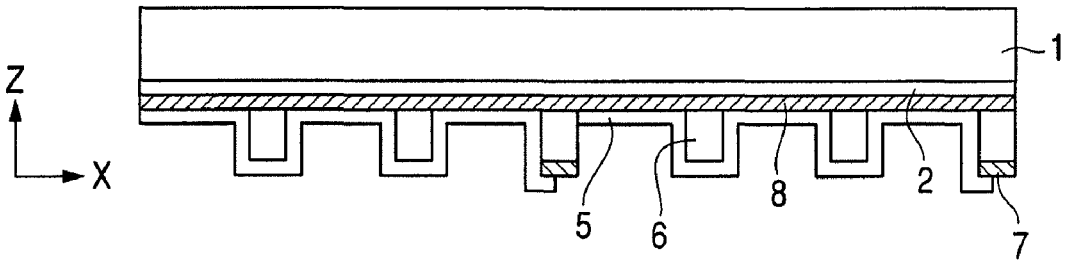

Further, it is unnecessary to provide the first resistors 7 on the overall rib tops. That is, in a case where the metal back 5 is formed so as to cover the two or more phosphors 4, the first resistor 7 may be formed on at least one rib 6 which can electrically connect the metal backs 5 adjacent in the Y direction. For example, as illustrated in FIGS. 2A and 2B, in a case where the metal back 5 covers the three phosphors adjacent in the Y direction and is connected to the first resistor 7 on the rib 6 which is positioned at an end in the Y direction, it is unnecessary to form the first resistor 7 on the two ribs 6 each of which is positioned between the phosphors adjacent in the X direction. Here, it should be noted that FIG. 2B is the cross section diagram taken along the line 2B-2B in FIG. 2A.

In the present invention, it is likewise desirable for the purpose of manufacture to make the shape of the second resistor 8 simple strip as exemplarily illustrated in FIGS. 1A to 1C. However, it should be noted that the second resistor 8 aims to adjust resistance Rx of the gap Gx. That is, if the second resistor 8 is formed so as to electrically connect the adjacent metal backs 5 in the X direction, it is possible to arbitrarily select the shape thereof. Therefore, it is of course possible to make the shape of the second resistor 8 complicated, and it is also possible to make the shape of the second resistor 8 discontinuous by intermittently forming it.

In the present invention, it is necessary to set each of the resistances of the first resistor 7 and the second resistor 8 to be sufficiently lower than the resistance of the rib 6. That is, it is preferable to set each of the resistances to be equal to or lower than 10 Ω·m. Moreover, it is desirable to set each of the resistances of the first resistor 7 and the second resistor 8 so that significant luminance deterioration due to a voltage drop does not occur when an image displaying apparatus is driven. If an emitted current of one electron-emitting device is within a range of 1 μA to 10 μA, it is desirable to set each of the resistances of the first resistor 7 and the second resistor 8 to be within a range of 1 KΩ to 1 GΩ. The practical upper limit of the resistance is determined within a range that the voltage drop is approximately equal to or lower than ten to several tens percents of the applied voltage and luminance unevenness does not occur. Further, it is desirable to set a withstand discharge characteristic of each of the first resistor 7 and the second resistor 8 to be equal to or higher than 1 MV/m.

Incidentally, as illustrated as the black matrix 2 in FIGS. 1B and 1C, it is desirable generally in the FED to provide a black or blackish light shielding layer between the phosphors 4 for the purpose of increasing a contrast. In the present invention, the rib 6, the first resistor 7 or the second resistor 8 may double as the light shielding layer. However, if a color of the material to be used for the rib 6, the first resistor 7 or the second resistor 8 is improper for the light shielding layer, the black matrix 2 or the black stripe may be provided as illustrated in FIGS. 1B and 1C.

Further, in the present embodiment, the ribs 6 are formed only in the Y direction. However, there is a case where the ribs 6 are formed only in the X direction or in both the X direction and the Y direction. Even in this case, if the resistors respectively formed on the rib tops and the rib bottoms are arranged so as to mutually cross, the same effect as above can be expected.

Typically, the X direction is the long axis direction of the landscape screen, and the Y direction is the short axis direction of the landscape screen. However, such a correlation is generally defined based on whether or not the relation Gx< Gy is satisfied. Since the R, G and B phosphors 4 are typically arranged in the long axis direction, the long axis direction is set as the X direction. However, there is a case where the short axis direction is set as the X direction according to the constitution of the FED.

Figure 3:
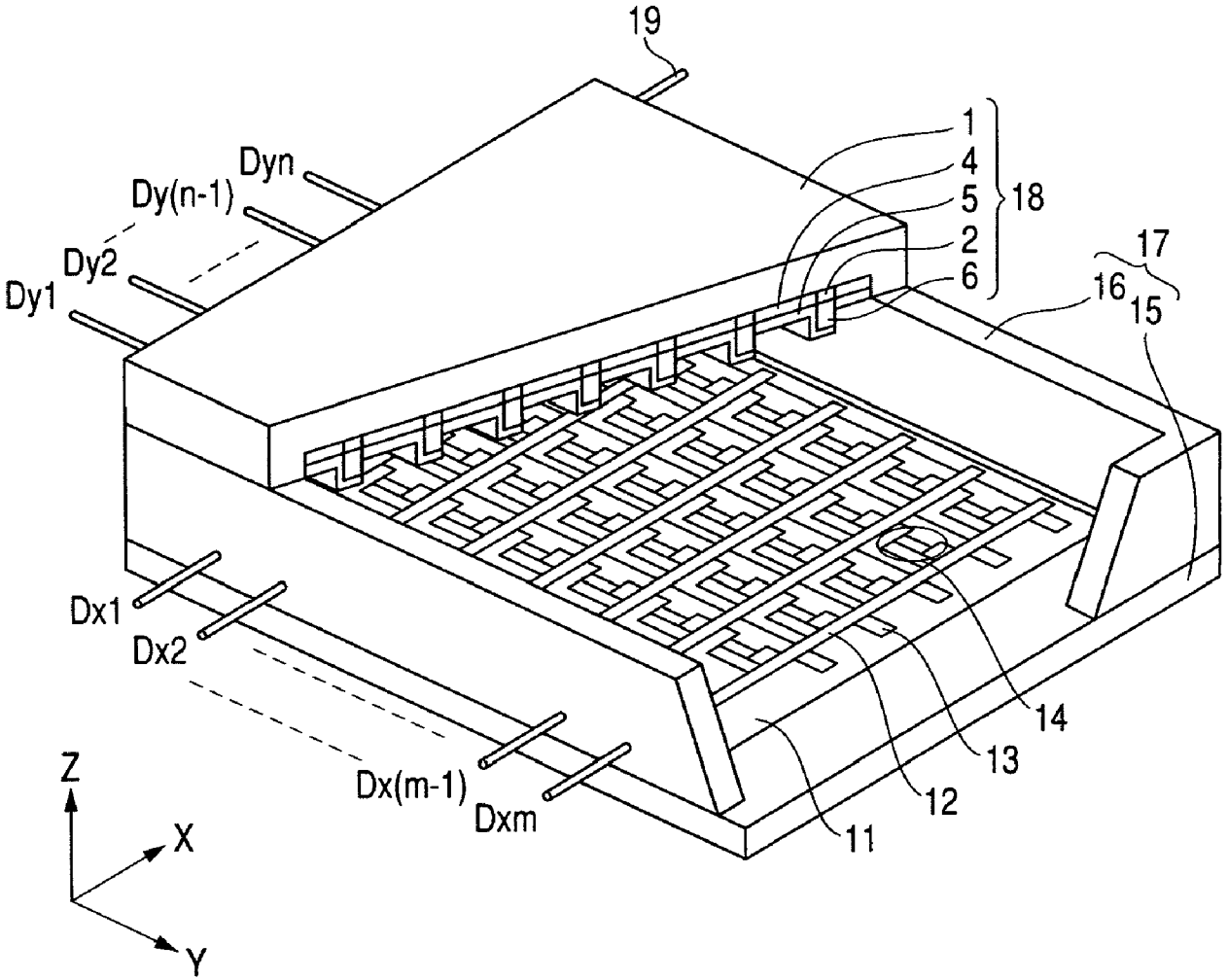
FIG. 3 is a perspective diagram schematically illustrating a displaying panel which is an example of an image displaying apparatus according to the present invention.

Subsequently, the image displaying apparatus in which the light emitter substrate according to the present invention is used will be described. FIG. 3 is a perspective diagram schematically illustrating the constitution of a displaying panel which is an example of the image displaying apparatus in which the light emitter substrate illustrated in FIGS. 1A to 1C is used, and a part of FIG. 3 is cut away. Here, it should be noted that the parts same as those illustrated in FIGS. 1A to 1C are indicated by the reference numerals same as those illustrated in FIGS. 1A to 1C respectively, and the description thereof will be omitted. Further, in FIG. 3, the first resistor 7 is omitted as a matter of convenience.

In FIG. 3, a face plate 18 is equivalent to the light emitter substrate exemplarily illustrated in FIGS. 1A to 1C. Further, plural surface-conduction electron-emitting devices 14, which are provided on an electron source substrate 11, are arranged in matrix by X-direction wirings 12 and Y-direction wirings 13, and the overall constitution formed is set on a rear plate 15. In the present embodiment, the m X-direction wirings 12 are formed, the n Y-direction wirings 13 are formed, and the m×n surface-conduction electron-emitting devices 14 are formed. Here, m and n, which are positive integers, are properly set according to the aimed number of displaying pixels.

Moreover, in FIG. 3, a support frame 16, the face plate 18 and the rear plate 15 together constitute a vacuum envelope 17 in which high vacuum of approximately $10^{-4}$ Pa or lower is maintained. In any case, the image displaying apparatus is constituted by properly adding a not-illustrated power supply, a not-illustrated driving circuit and the like to the vacuum envelope 17. More specifically, the metal back 5 is electrically connected to an Hv (high voltage) terminal 19 of the vacuum envelope 17, whereby high voltage of approximately 1 kV to 15 kV is applied from the high voltage supply through the Hv terminal 19. The m X-direction wirings 12 are electrically connected to terminals Dx1 to Dxm respectively, and the n Y-direction wirings 13 are electrically connected to terminals Dy1 to Dyn respectively, whereby scanning signals and image signals are supplied to the wirings through the terminals. Electrons according to the signals are emitted from the surface-conduction electron-emitting devices 14, and the emitted electrons are attracted by the potential of the metal backs 5. Then, the attracted electrons penetrate the metal backs 5, thereby causing the phosphors 4 to emit light. In this case, it is possible to adjust luminance based on the high voltage and the signals. Incidentally, a part of the electrons is diffused and reflected, and further a part of the diffused and reflected electrons again causes the phosphors to emit light, whereby so-called halation occurs. Consequently, if the light emitter substrate according to the present invention is used as the face plate 18, the halation can be suppressed. Thus, it is possible to provide the image displaying apparatus of which the withstand discharge function is excellent.

EXAMPLE 1

The light emitter substrate illustrated in FIG. 1 was manufactured according to the following processes.

Figure 4:
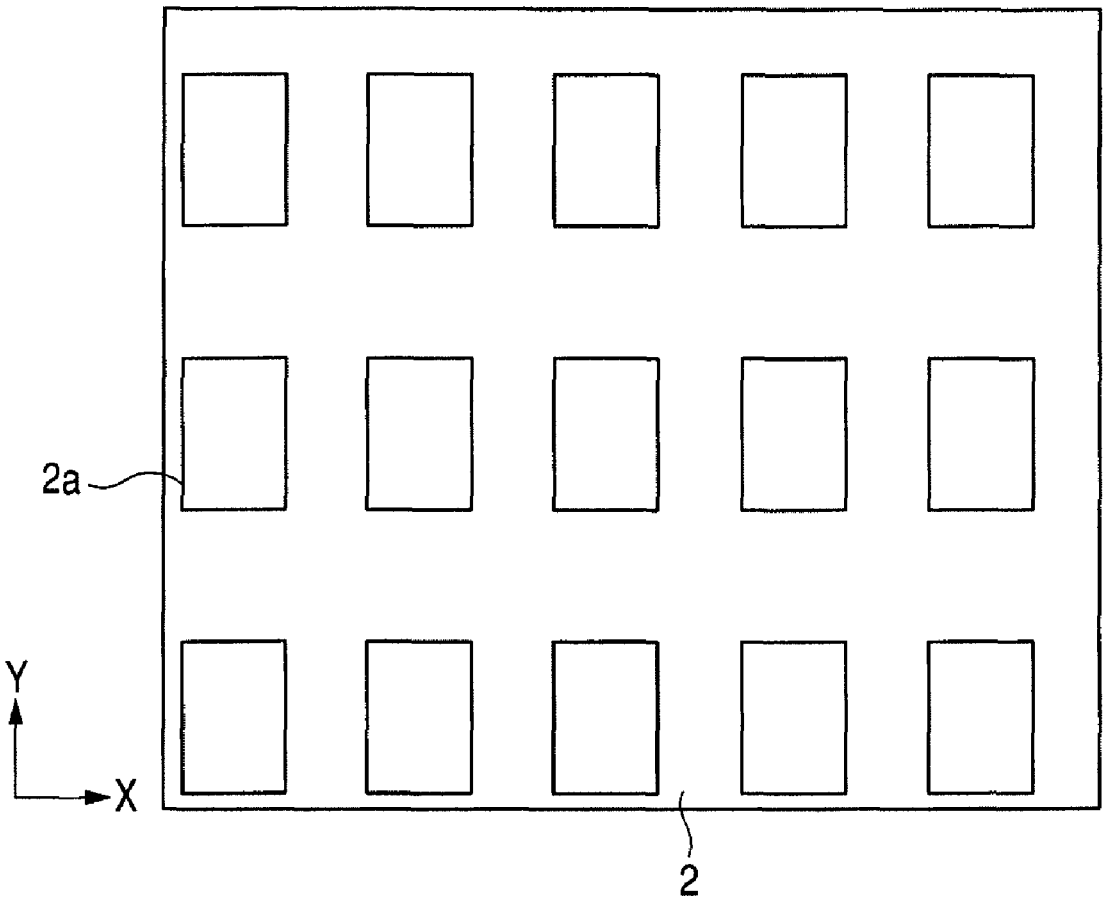
FIG. 4 is a diagram schematically illustrating a manufacturing process of the light emitter substrate according to the present invention.
Figure 5:
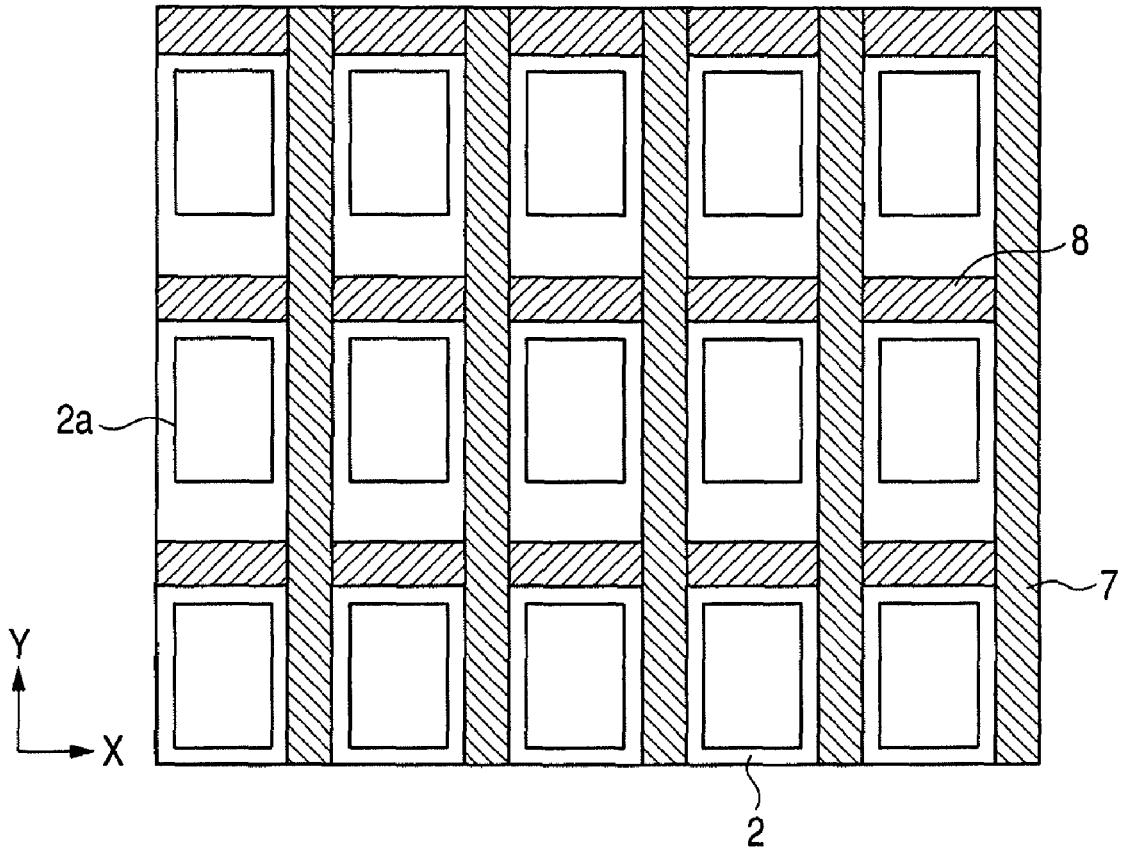
FIG. 5 is a diagram schematically illustrating a manufacturing process of the light emitter substrate according to the present invention.
Figure 6:
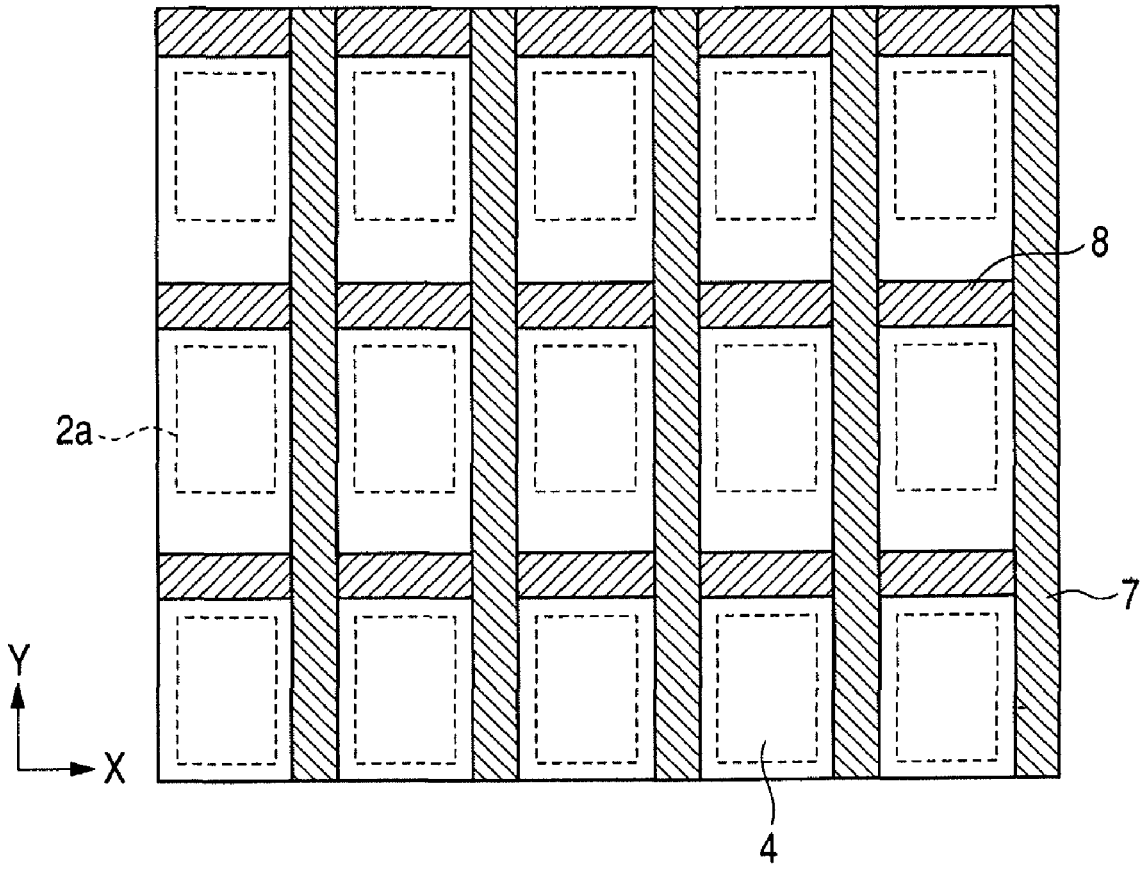
FIG. 6 is a diagram schematically illustrating a manufacturing process of the light emitter substrate according to the present invention.

First, a glass substrate (PD200: manufactured by Asahi Glass Co., Ltd.) having the thickness 2.8 mm was used as the substrate 1, and the black matrix 2 was formed on the substrate 1 by using a black paste (NP-7803D: manufactured by Noritake Kizai Co., Ltd.) (FIG. 4). Subsequently, the second resistors 8, the ribs 6 and the first resistors 7 were formed in this order by the photolithography method (FIG. 5). Further, the R, G and B phosphors 4 were applied and baked (FIG. 6). After then, the island-shaped metal backs 5 were formed on the phosphors 4 by the vacuum vapor deposition method (FIGS. 1A to 1C).

In this example, Al was used as the metal back 5. Further, the length of the metal back 5 in the X direction was set to 160 μm, the length of the metal back 5 in the Y direction was set to 200 μm, the gap Gx was set to 50 μm, and the gap Gy was set to 430 μm. An insulating material of which the volume resistance is 100 kΩ·m was used as the rib 6. Further, the width of the rib 6 was set to 50 μm, and the height of the rib 6 was set to 200 μm. A resistive material of which the volume resistance is 10 Ω·m was used as the first resistor 7. Since the first resistor 7 is formed on the rib 6, the width of the first resistor 7 was set to 50 μm which is the same as the width of the rib 6, and the film thickness of the first resistor 7 was set to 10 μm. Further, the resistive material which is the same as the resistive material used as the first resistor 7 and of which the volume resistance is 10 μm was used as the second resistor 8. Here, the width of the second resistor 8 was set to 200 μm, and the film thickness of the second resistor 8 was set to 10 μm.

In this example, by providing the second resistor 8 on the rib bottom, the resistance Rx between the metal backs adjacent in the X direction could be reduced. That is, if the resistor was formed only by the rib 6, the resistance thereof was Rx=125 MΩ. On the other hand, if the second resistor 8 was formed on the rib bottom, the resistance was Rx=250 kΩ.

The withstand discharge test by deteriorating the degree of vacuum of the inside was performed by using the image displaying apparatus using the relevant light emitter substrate. Then, it was confirmed that the withstand discharge break in the X direction did not occur, and that the current flowing at the time of discharge was reduced.

Moreover, any point defect did not occur at the discharge portion, whereby the same status as that before the discharge was generated could be maintained.

Moreover, the voltage drop at the time of driving the image displaying apparatus was equal to or lower than 250V, and, as far as it could be confirmed by visual observation, there was no problem of luminance deterioration.

A voltage Vx generated in the gap Gx at the time of discharge was calculated in regard to the light emitter substrate in which the second resistor 8 was formed on the rib bottom according to this example, and the obtained result was Vx=0.8 kV. On the other hand, a voltage Vx generated in the gap Gx at the time of discharge was calculated in regard to the light emitter substrate which was different from the light emitter substrate of this example only in the point that the second resistor 8 was not formed on the rib bottom, and the obtained result was Vx=3.5 kV. Thus, it was confirmed that the generated voltage could be reduced to approximately ¼ as compared with the conventional generated voltage, and it was thus confirmed that the discharge damage could be eliminated.

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2008-226616, filed Sep. 4, 2008, which is hereby incorporated by reference herein in its entirety.

What is claimed is:

1. A light emitter substrate comprising:

a substrate;

plural light emitter layers arranged in a first direction and in a second direction perpendicular to the first direction respectively at gaps, on the substrate;

a rib arranged between the light emitter layers adjacent in the second direction and extending the first direction;

plural metal backs each covering at least one of the light emitter layers and arranged in the first direction and in the second direction respectively at gaps;

a first resistor, extending in the first direction, positioned on the rib, adapted to electrically connect the metal backs adjacent in the first direction; and a second resistor, extending in the second direction, positioned between the ribs and the substrate, adapted to electrically connect the metal backs adjacent in the second direction, wherein volume resistance of the first resistor and volume resistance of the second resistor are lower than volume resistance of the rib, and when a gap between the metal backs in the second direction is Gx and a gap between the metal backs in the first direction is Gy, a relation Gx<Gy is satisfied.

2. An image displaying apparatus wherein an electron source substrate which is equipped with plural electron-emitting devices and the light emitter substrate which is described in claim 1 are mutually arranged oppositely.

* * * * *